US010990055B2

(12) United States Patent
Okamoto

(10) Patent No.: US 10,990,055 B2
(45) Date of Patent: Apr. 27, 2021

(54) IMAGE FORMING APPARATUS INCLUDING A CONVEYANCE GUIDE FOR GUIDING A RECORDING MEDIUM CONVEYED FROM A REGISTRATION ROLLER PAIR TO A TRANSFER NIP

(71) Applicant: KYOCERA Document Solutions Inc., Osaka (JP)

(72) Inventor: Sueaki Okamoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/915,827

(22) Filed: Jun. 29, 2020

(65) Prior Publication Data

US 2021/0003957 A1 Jan. 7, 2021

(30) Foreign Application Priority Data

Jul. 5, 2019 (JP) ..... JP2019-126009

(51) Int. Cl.
*G03G 21/00* (2006.01)
*G03G 15/00* (2006.01)
*G03G 15/16* (2006.01)

(52) U.S. Cl.
CPC ..... *G03G 15/6561* (2013.01); *G03G 15/1665* (2013.01)

(58) Field of Classification Search
USPC ..... 399/121
See application file for complete search history.

(56) References Cited

U.S. PATENT DOCUMENTS

| | | | | |
|---|---|---|---|---|
| 7,383,006 | B2 * | 6/2008 | Matsuura | G03G 15/167 399/313 |
| 7,894,757 | B2 * | 2/2011 | Matsuno | G03G 15/6558 399/316 |
| 8,953,990 | B2 * | 2/2015 | Okamoto | G03G 15/6555 399/316 |
| 2006/0171760 | A1 | 8/2006 | Deguchi | 400/642 |
| 2007/0269242 | A1 | 11/2007 | Hattori et al. | 399/316 |
| 2007/0269243 | A1 | 11/2007 | Uehara et al. | 399/316 |
| 2007/0269244 | A1 | 11/2007 | Miwa et al. | 399/316 |

(Continued)

FOREIGN PATENT DOCUMENTS

| | | |
|---|---|---|
| JP | 2006-208840 A | 8/2006 |
| JP | 2008-26810 A | 2/2008 |

*Primary Examiner* — Q Grainger
(74) *Attorney, Agent, or Firm* — Stein IP, LLC

(57) ABSTRACT

An image forming apparatus includes an image carrier, a transfer member, a registration roller pair, and a conveyance guide which includes a first conveyance guide and a second conveyance guide. The second conveyance guide has a main body portion and a shaft member. The shaft member is held by a shaft holding portion of the main body portion so as to be reciprocatable between a first position which is a most downstream-side position and a second position on an upstream side of the first position. When a first recording medium is conveyed, the shaft member is arranged at the first position such that a distance between the shaft member and the first conveyance guide is a predetermined distance. When a second recording medium is conveyed, the shaft member is arranged at the second position such that the distance between the shaft member and the first conveyance guide is increased.

11 Claims, 8 Drawing Sheets

(56) References Cited

U.S. PATENT DOCUMENTS

2015/0234344 A1* 8/2015 Oba ..... G03G 21/168
399/110
2019/0354057 A1* 11/2019 Okamoto ..... G03G 15/165

* cited by examiner

IMAGE FORMING APPARATUS INCLUDING A CONVEYANCE GUIDE FOR GUIDING A RECORDING MEDIUM CONVEYED FROM A REGISTRATION ROLLER PAIR TO A TRANSFER NIP

INCORPORATION BY REFERENCE

This application is based upon and claims the benefit of priority from the corresponding Japanese Patent Application No. 2019-126009 filed on Jul. 5, 2019, the entire contents of which are incorporated herein by reference.

BACKGROUND

The present disclosure relates to image forming apparatuses such as copiers, printers, facsimile machines, etc., and in particular, relates to a method for stabilizing a recording-medium conveyance state on an upstream side of an image carrier and a transfer member.

In an image forming apparatus using an electrophotographic method, toner is made to adhere to an electrostatic latent image formed on an image carrier such as a photosensitive drum to thereby form a toner image, which is transferred to a sheet-shaped recording medium such as a paper sheet, to be then fixed on the recording medium by a fixing device (a fixing portion).

In such an image forming apparatus, in view of space saving, units such as a photosensitive drum, a development device, etc. are closely spaced from each other, and thus the space around the photosensitive drum is highly airtight. In this configuration, for example, at a timing such as a timing when a leading end of a paper sheet coming from a registration roller pair enters a nip (a transfer nip) between the photosensitive drum and a transfer roller and a timing when a rear end of the paper sheet leaves the nip of the registration roller pair or an intermediate roller, the paper-sheet conveyance state changes (fluttering or abrupt position change of the paper sheet), and as a result, the volume of the conveyance space changes, and airflow is generated by a change of atmospheric pressure attributable to the volume change.

This airflow, when passing through a gap (a development nip) between the photosensitive drum and a development roller, scatters toner particles flying from the development roller to the photosensitive drum under a development electric field. As a result, the toner particles adhere, to the photosensitive drum, at positions displaced from their target adhesion positions, and this may cause a transverse line in a half-tone image or in a solid image.

On the other hand, if the distance between upper and lower pre-transfer guides, which are arranged on the upstream side of the transfer nip with respect to the sheet conveyance direction, is reduced to thereby prevent the fluttering of the paper sheet, it will increase a conveyance load in conveying a stiff paper sheet such as a thick paper sheet, and the increased conveyance load may invite transfer failures such as reduction of transfer magnification and transfer displacement.

To prevent such transfer failures, there has been proposed a method where, whether a paper sheet is a regular paper sheet or a thick paper sheet, the paper sheet is guided smoothly to the transfer nip, and specifically, there have been known a process cartridge and an image forming apparatus where first and second guide members, each made of a flexible film member, are provided on the upstream side of the transfer position to thereby maintain the entry state of a regular paper sheet into a photosensitive body while reducing the load on a thick paper sheet.

There has also been known a configuration including: a flexible guide plate which guides a paper sheet, conveyed by a sheet feed roller or the like, by supporting the paper sheet on one of its surfaces; and a sponge which is provided on the other surface of the guide plate and is softer than the guide plate, wherein the sponge is formed to project toward a photosensitive drum beyond an end of the guide plate on the photosensitive-drum side, to thereby reduce vibration of the guide plate and fluttering of the rear end of the paper sheet, and also to suppress fluttering noise made by the guide plate.

SUMMARY

According to one aspect of the present disclosure, an image forming apparatus includes an image carrier, a transfer member, a registration roller pair, and a conveyance guide. The transfer member transfers a toner image formed on the image carrier onto a recording medium. The registration roller pair conveys the recording medium to a transfer nip between the transfer member and the image carrier with a predetermined timing. The conveyance guide includes a first conveyance guide which faces an image-carrier-side surface of the recording medium conveyed from the registration roller pair to the transfer nip and a second conveyance guide which faces a transfer-member-side surface of the recording medium. The second conveyance guide has a main body portion and a shaft member. The main body portion has a projection portion which projects toward the first conveyance guide most in a recording-medium conveyance path from the registration roller pair to the transfer nip, and a shaft holding portion which is formed adjacent to the projection portion on a downstream side of the projection portion with respect to the recording-medium conveyance direction so as to extend along a width direction which is perpendicular to the recording-medium conveyance direction. The shaft member is held by the shaft holding portion so as to be reciprocatable between a first position which is a most downstream-side position in the shaft holding portion with respect to the recording-medium conveyance direction and a second position which is a position on an upstream side of the first position in the shaft holding portion. An outer peripheral surface of the shaft member projects toward the first conveyance guide beyond a plane passing through a downstream-side first-conveyance-guide-side end portion of the projection portion and a downstream-side first-conveyance-guide-side end portion of the shaft holding portion with respect to the recording-medium conveyance direction. When a first recording medium is conveyed, the shaft member is arranged at the first position such that a distance between the shaft member and the first conveyance guide is equal to a predetermined distance. When a second recording medium having a higher stiffness than the first recording medium, the shaft member is arranged at the second position such that the distance between the shaft member and the first conveyance guide is longer than when the shaft member is arranged at the first position.

Still other objects of the present disclosure and specific advantages provided by the present disclosure will be made further apparent from the following description of an embodiment.

DETAILED DESCRIPTION

Figure 1:
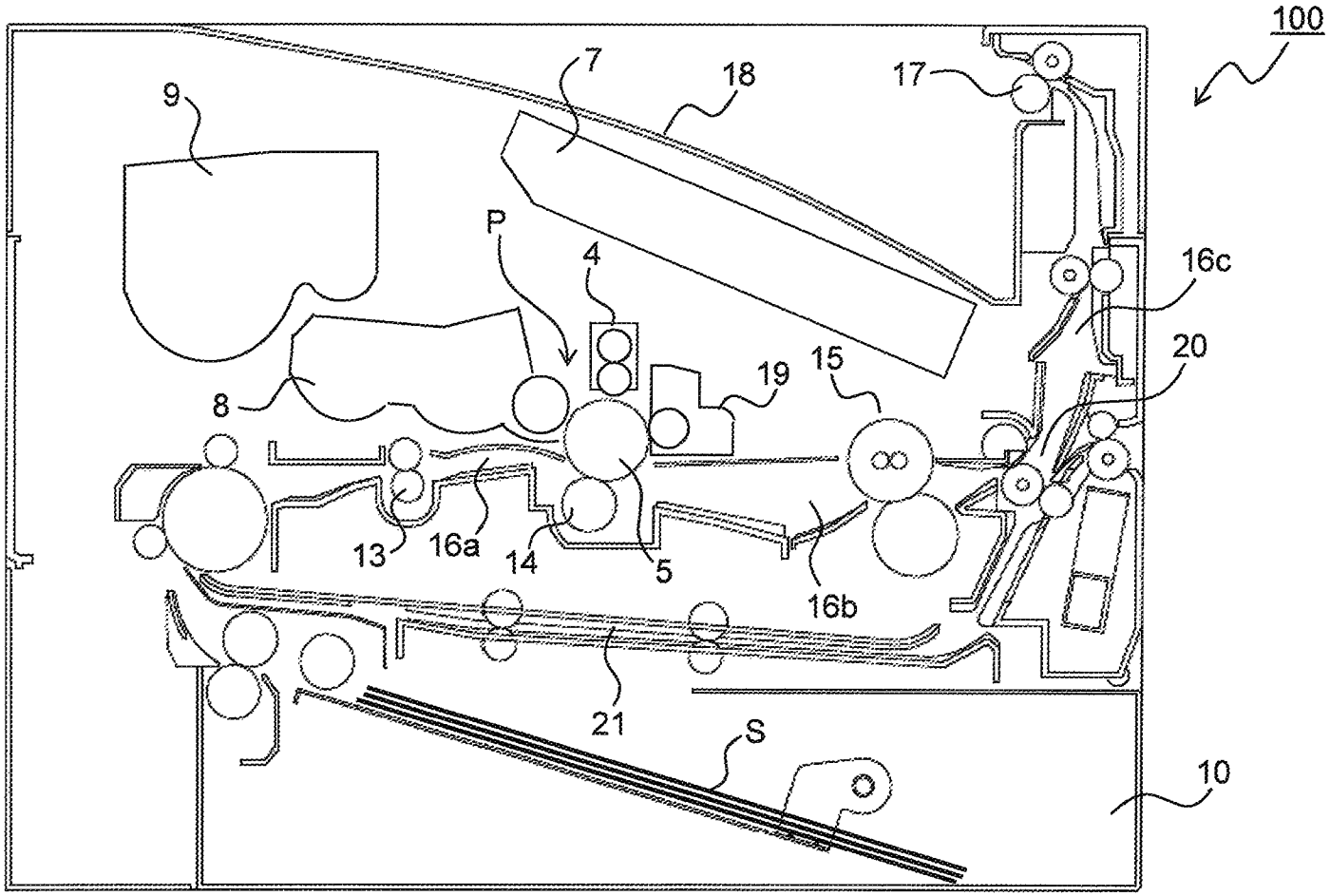
FIG. 1 is a side sectional view showing an internal structure of an image forming apparatus according to a first embodiment of the present disclosure.
Figure 2:
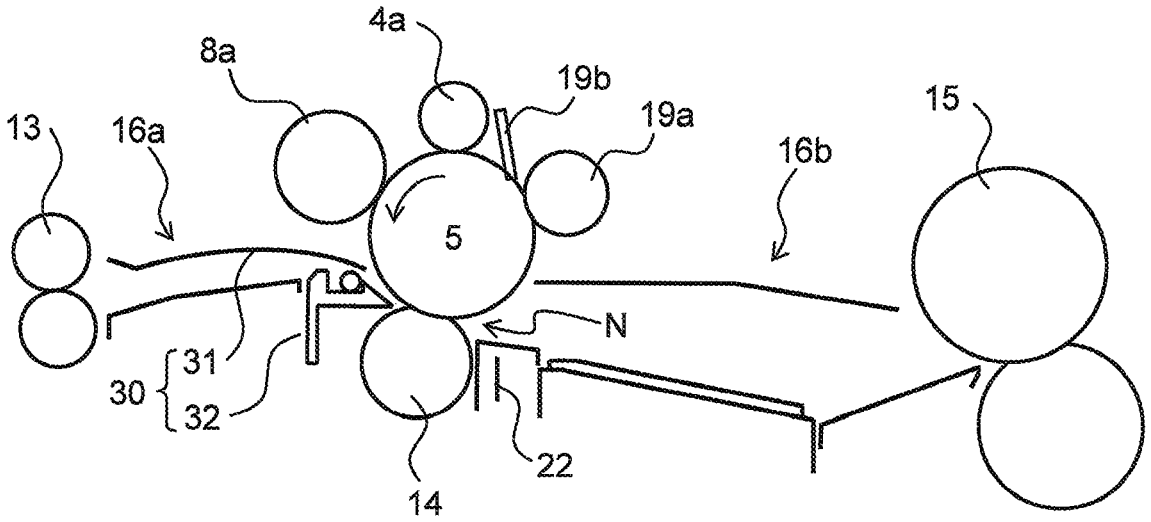
FIG. 2 is a partial enlarged view showing a sheet conveyance path from a registration roller pair to a fixing device shown in FIG. 1.

Hereinafter, embodiments of the present disclosure will be described with reference to the accompanying drawings. FIG. 1 is a side sectional view showing an internal structure of an image forming apparatus 100 according to a first embodiment of the present disclosure. FIG. 2 is a partial enlarged view showing a sheet conveyance path from a registration roller pair 13 to a fixing device 15 shown in FIG. 1. As shown in FIG. 1, inside the image forming apparatus (for example, a monochrome printer) 100, there is disposed an image forming portion P, which forms a monochrome image through charge, exposure, development, and transfer steps. The image forming portion P has arranged therein, along a rotation direction of a photosensitive drum 5 (a counterclockwise direction in FIG. 1), a charging device 4, an exposure device (such as a laser scanning unit) 7, a development device 8, a transfer roller 14, a cleaning device 19, and a charge eliminating device (not shown).

The charging device 4 has a charging roller 4*a* which contacts the photosensitive drum 5 and applies a charging bias to a surface of the drum. The charging roller 4*a* is made of an electrically conductive rubber, and is arranged in contact with the photosensitive drum 5. When the photosensitive drum 5 rotates in the counterclockwise direction in FIG. 2, the charging roller 4*a*, which is in contact with the surface of the photosensitive drum 5, follows to rotate in the clockwise direction in FIG. 2. At this time, a predetermined voltage is applied to the charging roller 4*a*, and thereby, the surface of the photosensitive drum 5 is uniformly charged.

The development device 8 includes a development roller 8*a*, and with the development roller 8*a*, develops an electrostatic latent image formed on the photosensitive drum 5 into a toner image. The development roller 8*a* is arranged to be spaced from the photosensitive drum 5 by a predetermined gap (development nip), and rotates in the clockwise direction in FIG. 2. Inside the development device 8, there is stored a one-component developer (hereinafter may also be referred to simply as "toner") constituted by a magnetic toner component alone. The toner is replenished to the development device 8 from a toner container 9.

The transfer roller 14 forms a transfer nip N by being in contact with the photosensitive drum 5, and transfers, onto a sheet S passing through the transfer nip N, a toner image formed on the surface of the photosensitive drum 5. The transfer roller 14 has connected thereto a transfer-bias power supply for applying a transfer bias, which is opposite in polarity to the toner, and a bias control circuit (of which neither is shown). Immediately near the transfer roller 14 on its downstream side with respect to the sheet conveyance direction, a charge eliminating needle 22 is arranged. The charge eliminating needle 22 applies a bias (transfer reverse bias) of the same polarity (positive polarity) as the toner, to eliminate residual charge (negative charge) remaining on the sheet S having passed through the transfer nip N, and this facilitates the separation of the sheet S from the photosensitive drum 5.

The transfer roller 14 is installed at a position offset from a lower end portion of the photosensitive drum 5 toward the upstream side (left side in FIG. 2) with respect to the sheet conveyance direction. With this arrangement, the conveyance direction of the sheet S after passing through the transfer nip N points downward, and this helps make it unlikely for the sheet S to be curled up. This allows the charge eliminating needle 22 to preferably eliminate charge from the sheet S having passed through the transfer nip N. This also helps reduce occurrence of winding of the sheet S around the photosensitive drum 5 when curvature separation of the sheet S from the photosensitive drum 5 is performed.

The cleaning device 19 has a rubbing roller 19*a* and a cleaning blade 19*b*, removes residual toner remaining on the surface of the photosensitive drum 5 while polishing the surface of the photosensitive drum 5. Further, the charge eliminating device (not shown) which eliminates residual charge remaining on the surface of the photosensitive drum 5 is provided on the downstream side of the cleaning device 19.

On a first sheet conveyance path 16*a* provided between the registration roller pair 13 and the transfer roller 14, a conveyance guide 30 is arranged. The conveyance guide 30 extends along a sheet width direction (a direction perpendicular to the sheet on which FIG. 2 is drawn), and includes an upper conveyance guide 31 facing an upper surface of the sheet S and a lower conveyance guide 32 facing a lower surface of the sheet S.

The registration roller pair 13 is arranged below a tangential direction of the photosensitive drum 5 on the entry side of the transfer nip N. With this arrangement, the registration roller pair 13 is out of an attachment/detachment path of the development device 8, the toner container 9, and the photosensitive drum 5, and this contributes to improved maintainability of the development device 8, the toner container 9, and a drum unit including the photosensitive drum 5.

Further, as for the entry route of the sheet S into the transfer nip N, to reduce scattering of toner on the upstream side of the transfer nip N, it is preferable to convey the sheet S along the photosensitive drum 5 before the sheet S comes into contact with the transfer roller 14. Thus, the first sheet conveyance path (pre-transfer conveyance path) 16*a* from the registration roller pair 13 to the transfer nip N is configured in a reverse-V shape with the upper conveyance guide 31 and the lower conveyance guide 32 such that it is inclined once upward from the registration roller pair 13 and then downward toward the transfer nip N.

In an image forming operation, the charging device 4 uniformly charges the photosensitive drum 5 rotating in the counterclockwise direction. Next, an electrostatic latent image is formed on the photosensitive drum 5 with a laser beam emitted from the exposure device 7 based on image data transmitted from a personal computer (not shown) or the like. Then, the development device 8 makes a developer (hereinafter called "toner") adhere to the electrostatic latent image, and thereby a toner image is formed.

Toward the photosensitive drum 5, on which the toner image has been formed in the above manner, the sheet S is conveyed from a sheet cassette 10 via the registration roller pair 13 and the first sheet conveyance path 16*a*, and by the transfer roller 14, the toner image having been formed on the surface of the photosensitive drum 5 is transferred onto the sheet S. After the toner image is transferred onto the sheet S, the sheet S is separated from the photosensitive drum 5 to be conveyed via a second sheet conveyance path 16*b* to the fixing device 15, where the toner image is fixed on the sheet S.

After passing through the fixing device 15, the sheet S is conveyed via a third sheet conveyance path 16*c* to an upper portion of the image forming apparatus 100. In a case of forming an image only on one side of the sheet S (in single-sided printing), the sheet S is discharged via a discharge roller pair 17 onto a discharge tray 18.

On the other hand, in a case of forming an image on each side of the sheet S (in double-sided printing), after the rear end of the sheet S passes through a branching portion 20 in the second sheet conveyance path 16*b*, the discharge roller pair 17 is reversely rotated to reverse the conveyance direction. Consequently, the sheet S is guided into a reverse conveyance path 21 from the branching portion 20 to be conveyed back to the registration roller pair 13, with its printed side turned upside down. Then, a next toner image formed on the photosensitive drum 5 is transferred by the transfer roller 14 onto the side of the sheet S on which no image has been printed yet. After having the toner image transferred thereto, the sheet S is conveyed to the fixing device 15 to have the toner image fixed thereon, and then is discharged onto the discharge tray 18 via the discharge roller pair 17.

Figure 3:
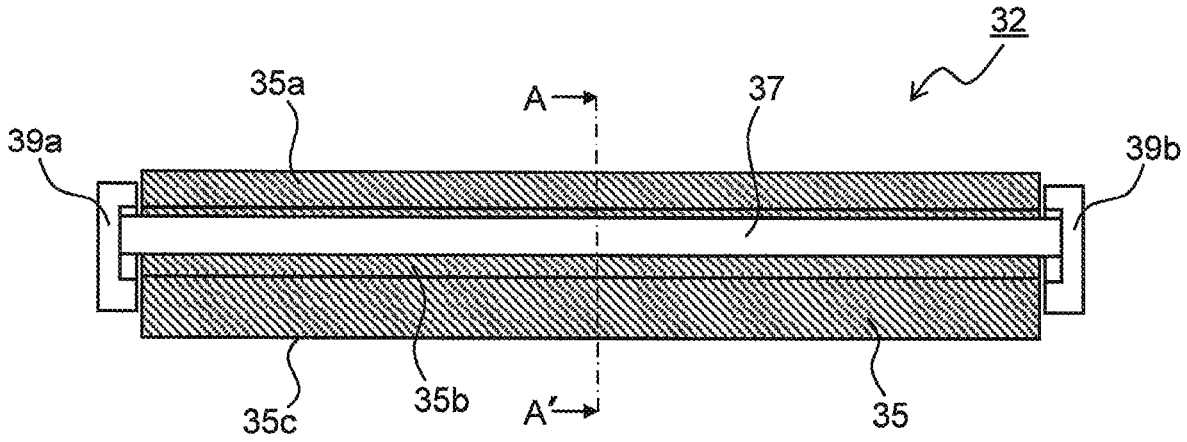
FIG. 3 is a plan view, as seen from above, of a lower conveyance guide constituting a conveyance guide used in the image forming apparatus of the first embodiment.
Figure 4:
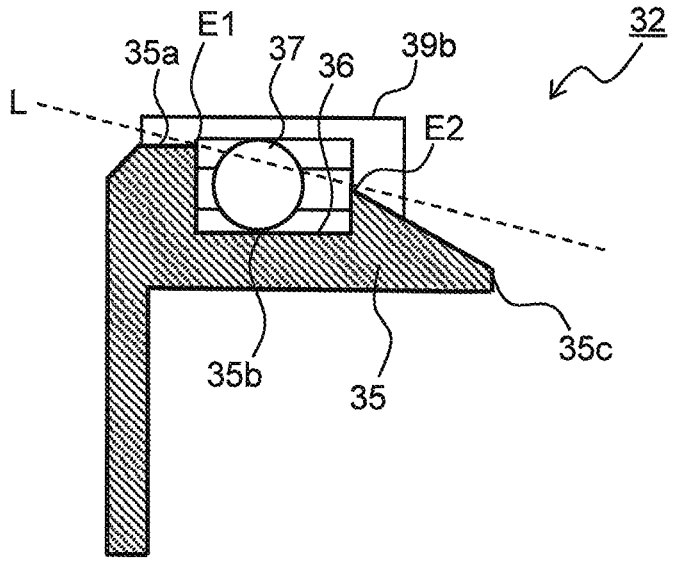
FIG. 4 is a side sectional view, taken along a conveyance direction, of the lower conveyance guide.

FIG. 3 is a plan view, as seen from above, of the lower conveyance guide 32 constituting the conveyance guide 30. FIG. 4 is a side sectional view taken along the conveyance direction (a sectional view taken along line AA' of FIG. 3). The lower conveyance guide 32 has a main body portion 35, a shaft member 37, and bearing members 39*a* and 39*b*.

The main body portion 35 is made of an electrically conductive resin material. The main body portion 35 has a projection portion 35*a* which projects upward most in the first sheet conveyance path 16*a* provided from the registration roller pair 13 to the transfer nip N, a shaft holding portion 35*b* which is formed in a recessed shape adjacent to the projection portion 35*a*, on the downstream side of the projection portion 35*a* with respect to the sheet conveyance direction, and a leading end portion 35*c* which extends near the transfer nip N, on the downstream side of the shaft holding portion 35*b* (see FIG. 2). The shaft holding portion 35*b* has a support surface (a sliding surface) 36 which is a horizontal surface with which the shaft member 37 is in contact.

The shaft member 37 is a rod-shaped member which is circular in section and of which an axial length is substantially equal to a length of the main body portion 35 in a sheet width direction (a left-right direction in FIG. 3, a direction perpendicular to the sheet on which FIG. 4 is drawn, hereinafter may also be simply referred to as "width direction"). The shaft member 37 is held by the shaft holding portion 35*b* of the main body portion 35 to be movable in the sheet conveyance direction (an up-down direction in FIG. 3, a left-right direction in FIG. 4, hereinafter may also be simply referred to as "conveyance direction"). In the present embodiment, a metal shaft is used as the shaft member 37. The shaft member 37 has an outer diameter such that its outer peripheral surface projects toward the upper conveyance guide 31 beyond a plane L passing through a downstream-side edge portion E1 of the projection portion 35*a* with respect to the conveyance direction and a downstream-side edge portion E2 of the shaft holding portion 35*b* with respect to the conveyance direction.

The bearing members 39*a* and 39*b* are respectively arranged at opposite end portions of the main body portion 35 in the width direction, and supports the shaft member 37 to be rotatable and also movable in the conveyance direction, restricting axial movement and upward movement of the shaft member 37.

Figure 5:
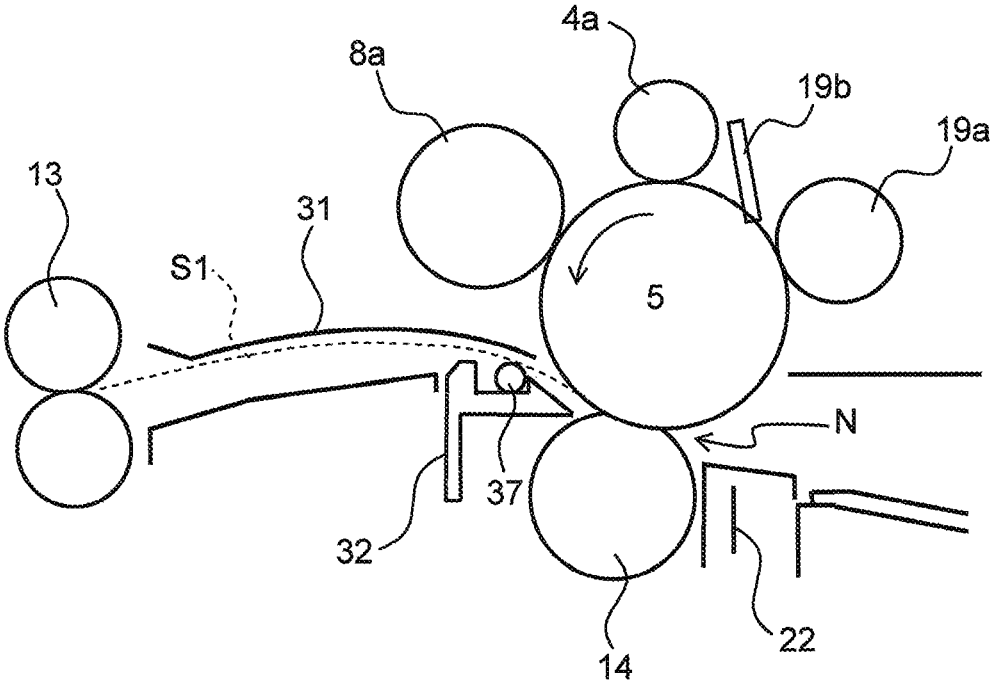
FIG. 5 is a side sectional view showing a conveyance state of a sheet conveyed from the registration roller pair to a transfer nip in the image forming apparatus of the first embodiment when the sheet is a regular paper sheet.
Figure 6:
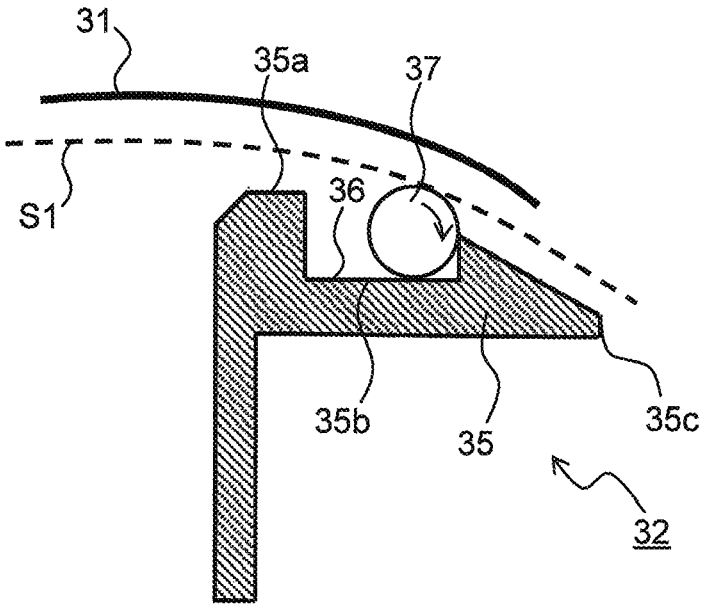
FIG. 6 is an enlarged view of the lower conveyance guide shown in FIG. 5.

Next, a description will be given of how the sheet S is conveyed from the registration roller pair 13 to the transfer nip N in the image forming apparatus 100 of the first embodiment. FIG. 5 is a side sectional view showing a conveyance state of a regular paper sheet S1 conveyed from the registration roller pair 13 to the transfer nip N in the image forming apparatus 100 of the first embodiment. FIG. 6 is an enlarged view of and around the lower conveyance guide 32 shown in FIG. 5. When the regular paper sheet S1 is conveyed, the shaft member 37 is pushed by the regular paper sheet S1 to roll toward the downstream side in the conveyance direction to be held, as shown in FIG. 6, at a most downstream-side position (a first position) within the shaft holding portion 35*b*.

As a result, a topmost portion of the shaft member 37 approaches the upper conveyance guide 31, and thus, as shown in FIG. 6, the regular paper sheet S1 is conveyed along a conveyance course (indicated by a broken line in FIG. 5 and FIG. 6) near the upper conveyance guide 31 over an entire region in the width direction. With this arrangement, a gap between the regular paper sheet S1 and the upper conveyance guide 31 is not widened, and this helps reduce fluttering of the regular paper sheet S1. This accordingly helps reduce toner scattering at the development nip due to the generation of an airflow.

Figure 7:
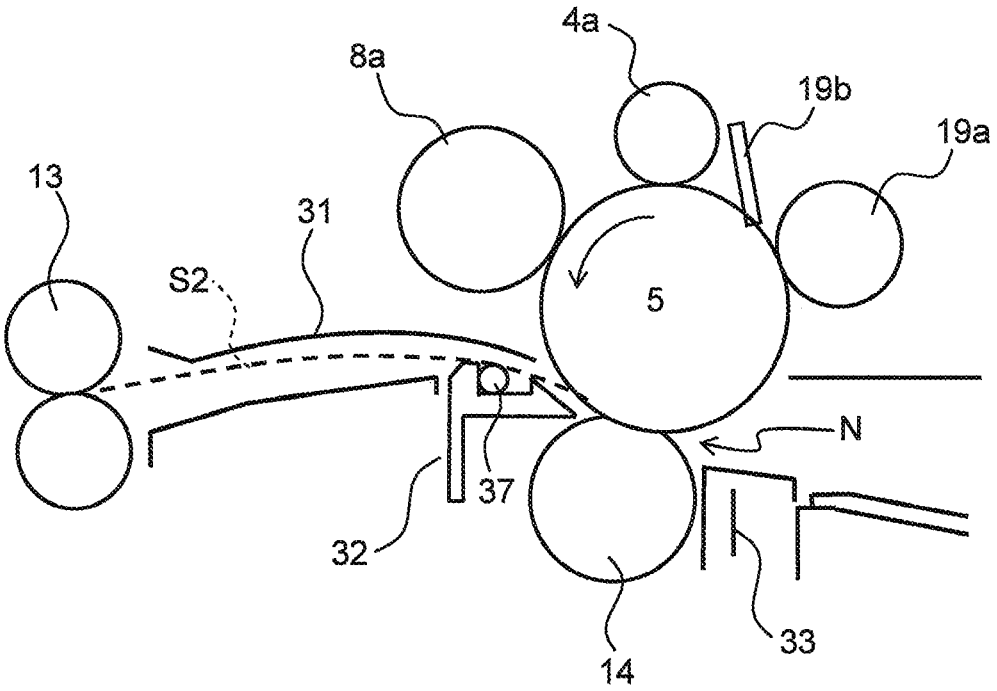
FIG. 7 is a side sectional view showing a conveyance state of a sheet conveyed from the registration roller pair to the transfer nip in the image forming apparatus of the first embodiment when the sheet is a thick paper sheet.
Figure 8:
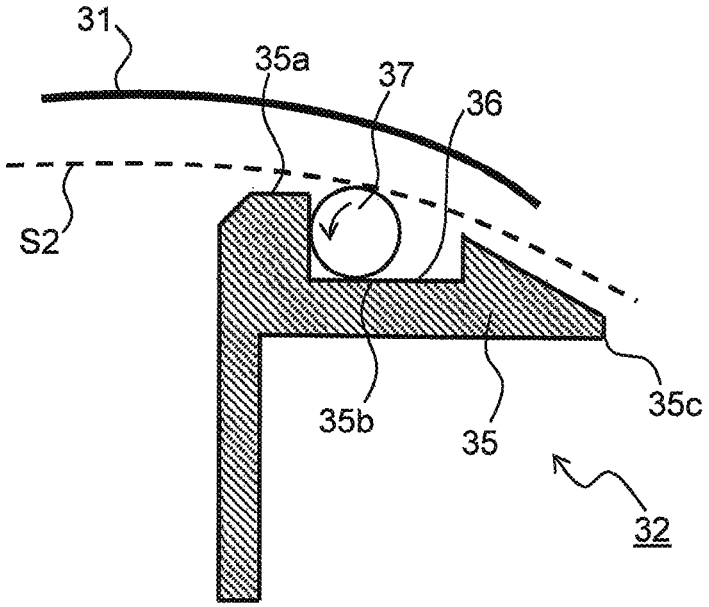
FIG. 8 is an enlarged view of the lower conveyance guide shown in FIG. 7.

FIG. 7 is a side sectional view showing a conveyance state of a thick paper sheet S2 conveyed from the registration roller pair 13 to the transfer nip N in the image forming apparatus 100 of the first embodiment. FIG. 8 is an enlarged view of and around the lower conveyance guide 32 shown in FIG. 7. In a same manner as in the case of conveying the regular paper sheet S1, the shaft member 37 is pushed by the thick paper sheet S2 to roll once toward the downstream side in the conveyance direction, but, since the thick paper sheet S2 has a high stiffness, the shaft member 37 is pushed back by the stiffness (restoring force) of the thick paper sheet S2 toward the upstream side in the conveyance direction. In this manner, as shown in FIG. 8, the shaft member 37 is held at a position (a second position) which is on the upstream side of the first position within the shaft holding portion 35*b*.

As a result, the topmost portion of the shaft member 37 is farther away from the upper conveyance guide 31 than when the regular paper sheet S1 is conveyed, and thus, as shown in FIG. 8, the thick paper sheet S2 is conveyed along a conveyance course (indicated by a broken line in FIG. 7 and FIG. 8) that is near the lower conveyance guide 32 over the entire region in the width direction. Here, the amount of movement of the shaft member 37 in the conveyance direction is restricted by the length of the shaft holding portion 35*b* in the conveyance direction, and thus, the distance between the shaft member 37 and the upper conveyance guide 31 when the shaft member 37 has moved to the second position is maintained constant. Accordingly, also when conveying the thick paper sheet S2, it is possible to reduce the conveyance load while minimizing the fluttering width of the thick paper sheet S2.

Here, the sheet S is conveyed in contact with the outer peripheral surface (a curved surface) of the shaft member 37, and thus friction between the sheet S and the lower conveyance guide 32 is reduced, and, in particular, when conveying the thick paper sheet S2, the conveyance load is further reduced.

According to the configuration of the present embodiment, the shaft member 37 is arranged such that the outer peripheral surface of the shaft member 37 projects upward beyond the plane L passing through the downstream-side edge portion E1 of the projection portion 35*a* with respect to the conveyance direction and the downstream-side edge portion E2 of the shaft holding portion 35*b* with respect to the conveyance direction. With this arrangement, when conveying the regular paper sheet S1, which has a low stiffness, the shaft member 37 moves to the first position, so that the distance between the shaft member 37 and the upper conveyance guide 31 is reduced. As a result, the sheet S can be conveyed along a course near the upper conveyance guide 31, and fluttering of the rear end of the sheet S is reduced.

On the other hand, when conveying the thick paper sheet S2 with a high stiffness, the shaft member 37 moves to the second position, so that the distance between the shaft member 37 and the upper conveyance guide 31 is increased, and as a result, the conveyance load is reduced. Also, the distance between the shaft member 37 and the upper conveyance guide 31 is maintained constant, and this helps reduce, as much as possible, the fluttering of the rear end of the thick paper sheet S2 during conveyance.

Accordingly, fluttering of the rear end of the sheet S is reduced regardless of the stiffness of the sheet S, and thus it is possible to suppress toner scattering caused at the development nip due to generation of an airflow. Furthermore, it is also possible to suppress reduction of transfer magnification and occurrence of transfer displacement due to an increased conveyance load with respect to the sheet S.

Further, in the image forming apparatus 100 of the present embodiment, the first sheet conveyance path 16*a* provided from the registration roller pair 13 to the transfer nip N is configured in a reverse-V shape such that it is inclined once upward from the registration roller pair 13 and then downward toward the transfer nip N. In this case, the conveyance load is likely to be large when conveying a highly stiff sheet S such as the thick paper sheet S2, and thus it is particularly preferable to use the lower conveyance guide 32 of the present embodiment.

Figure 9:
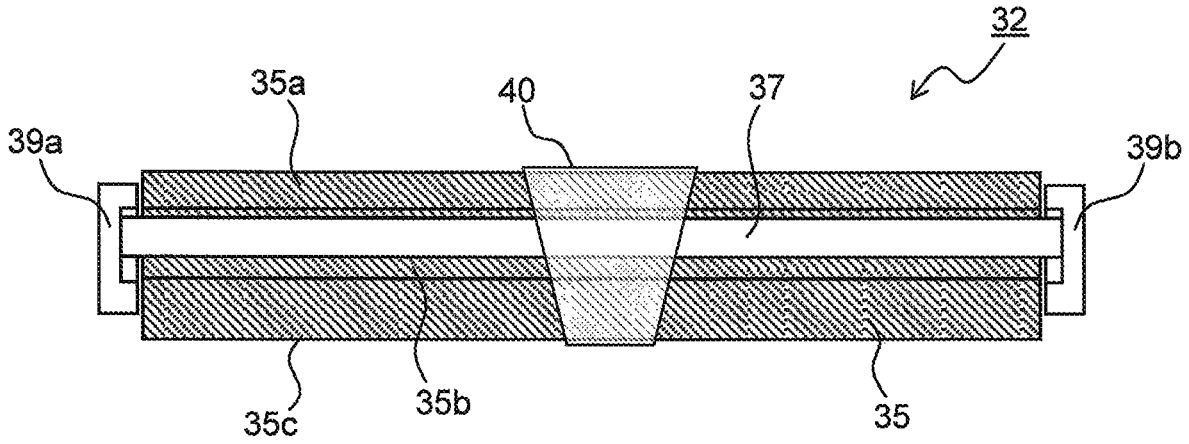
FIG. 9 is a plan view, as seen from above, of a modified example of the lower conveyance guide used in the image forming apparatus of the first embodiment.

FIG. 9 is a plan view, as seen from above, of a modified example of the lower conveyance guide 32 used in the image forming apparatus 100 of the first embodiment. In the modified example shown in FIG. 9, at a central portion of the lower conveyance guide 32 in the width direction, there is provided a film member 40 which covers an upper face of the lower conveyance guide 32 including the shaft member 37.

The film member 40 is wound around and fixed to the lower conveyance guide 32 so as to cover, from the projection portion 35*a*, over the shaft member 37, to the leading end portion 35*c* of the main body portion 35, an opposing face of the lower conveyance guide 32, including the shaft member 37, the opposing face facing the upper conveyance guide 31. As the material of the film member 40, as in a second embodiment which will be described later, an electrically conductive ultra-high molecular weight polyethylene sheet is used.

According to the configuration shown in FIG. 9, since the sheet S is conveyed along a surface of the film member 40, there is no risk of the leading end of the sheet S entering the gap between the shaft member 37 and the shaft holding portion 35*b*, and jamming of the sheet S passing over the lower conveyance guide 32 can be prevented.

The film member 40 needs to be wound and fixed under such a tension that does not hamper the movement of the shaft member 37. Here, the film member 40 is provided at one position at the center portion in the width direction, but the film member 40 may instead be provided at each of a plurality of positions.

Figure 10:
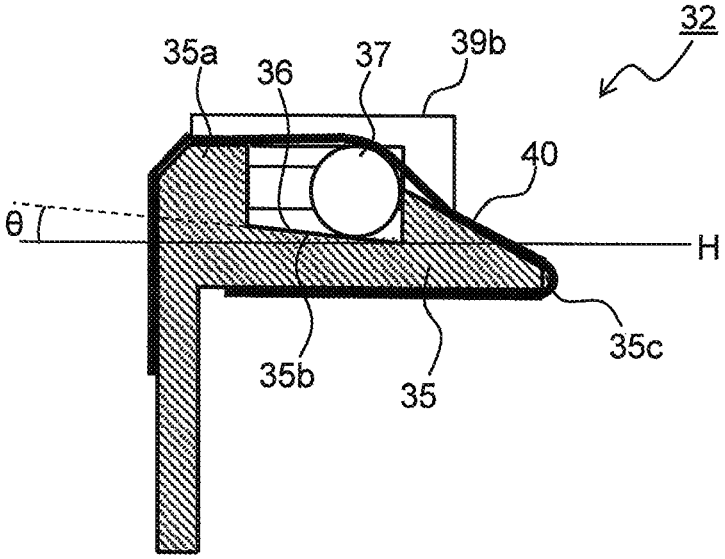
FIG. 10 is a side sectional view, taken along the conveyance direction, of a lower conveyance guide used in an image forming apparatus according to a second embodiment of the present disclosure.

FIG. 10 is a side sectional view, taken along the conveyance direction, of a lower conveyance guide 32 used in an image forming apparatus 100 according to the second embodiment of the present disclosure. In the lower conveyance guide 32 of the present embodiment, over an entire region of the lower conveyance guide 32 in the width direction, a film member 40 is provided to cover an upper face of the lower conveyance guide 32 including a shaft member 37. The other portions of the lower conveyance guide 32 are configured in a manner similar to the first embodiment.

The film member 40 is wound around and fixed to the lower conveyance guide 32 so as to cover, over the entire region in the width direction, an opposing face of the lower conveyance guide 32 from a projection portion 35*a*, over the shaft member 37, to a leading end portion 35*c* of a main body portion 35, the opposing face facing an upper conveyance guide 31. The film member 40 is fixed under such a tension that allows the shaft member 37 to move in the conveyance direction. As the material of the film member 40, a resin film is preferable for its high wear resistance and preferable slidability. It is also preferable that the film member 40 be electrically conductive in view of preventing adhesion of toner due to static electricity caused by friction with the sheet S. In the present embodiment, as the film member 40, an electrically conductive ultra-high molecular weight polyethylene sheet is used.

Further, in view of allowing escape of electric charge accumulated in the film member 40 due to friction with the sheet S, it is preferable that the film member 40 be grounded (earthed). The film member 40 may be grounded by being directly connected to a frame (not shown) of the image forming apparatus 100, or, if the main body portion 35 is electrically conductive, the film member 40 may be grounded via the main body portion 35. Here, in a case where the sheet S has a low resistance due to, for example, moisture contained therein, the transfer bias leaks to the ground via the sheet S and the lower conveyance guide 32. Thus, it is preferable to ground the film member 40 via a resistor (a high-resistance metal-glaze resistor) having a resistance of the order of megohms.

In the lower conveyance guide 32 provided with the film member 40, it is difficult for the shaft member 37 to move in the conveyance direction as smoothly as in the first embodiment where the lower conveyance guide 32 is not provided with the film member 40 or the film member 40 is provided only at a part of the lower conveyance guide 32 in the width direction. In particular, when conveying the regular paper sheet S1 with a low stiffness, it tends to be difficult for the shaft member 37 to move smoothly in the conveyance direction. To cope with this, in the present embodiment, a shaft holding portion 35*b* has a first support surface 36 which is inclined downward toward the downstream side in the conveyance direction by an angle θ with respect to a horizontal plane H. With this arrangement, the shaft member 37 is caused by its own weight to roll in the conveyance direction along the first support surface 36 of the shaft holding portion 35*b* to be securely held at the first position in the shaft holding portion 35*b*.

Figure 11:
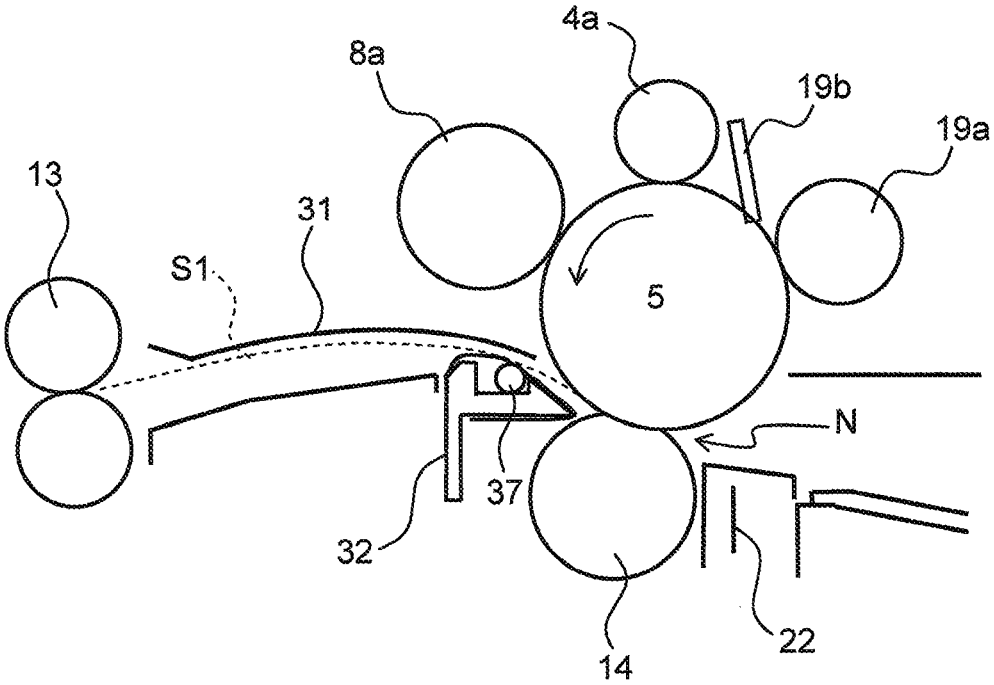
FIG. 11 is a side sectional view showing a conveyance state of a sheet conveyed from a registration roller pair to a transfer nip in the image forming apparatus of the second embodiment when the sheet is a regular paper sheet.
Figure 12:
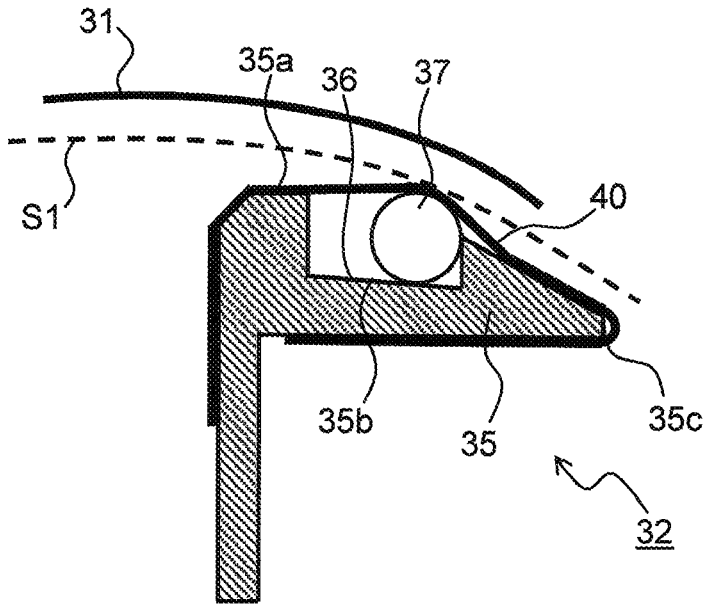
FIG. 12 is an enlarged view of a lower conveyance guide shown in FIG. 11.

FIG. 11 is a side sectional view showing a conveyance state of the sheet S conveyed from a registration roller pair 13 to a transfer nip N in the image forming apparatus 100 of the second embodiment when the sheet is a regular paper sheet S1. FIG. 12 is an enlarged view of and around the lower conveyance guide 32 shown in FIG. 11. With the configuration of the present embodiment, the shaft member 37 rolls along the first support surface 36, which is a slope, toward the downstream side in the conveyance direction, to be held at the first position in the shaft holding portion 35*b* as shown in FIG. 12. Further, the film member 40 is supported in a convex shape by the topmost portion of the shaft member 37.

As a result, a topmost portion of the shaft member 37 approaches the upper conveyance guide 31, and thus, as shown in FIG. 11 and FIG. 12, the regular paper sheet S1 is conveyed along a conveyance course (indicated by a broken line in FIG. 11 and FIG. 12) that is near the upper conveyance guide 31. With this arrangement, a gap between the regular paper sheet S1 and the upper conveyance guide 31 is not widened, and this helps reduce fluttering of the regular paper sheet S1. This accordingly helps suppress toner scattering at the development nip due to generation of an airflow.

Figure 13:
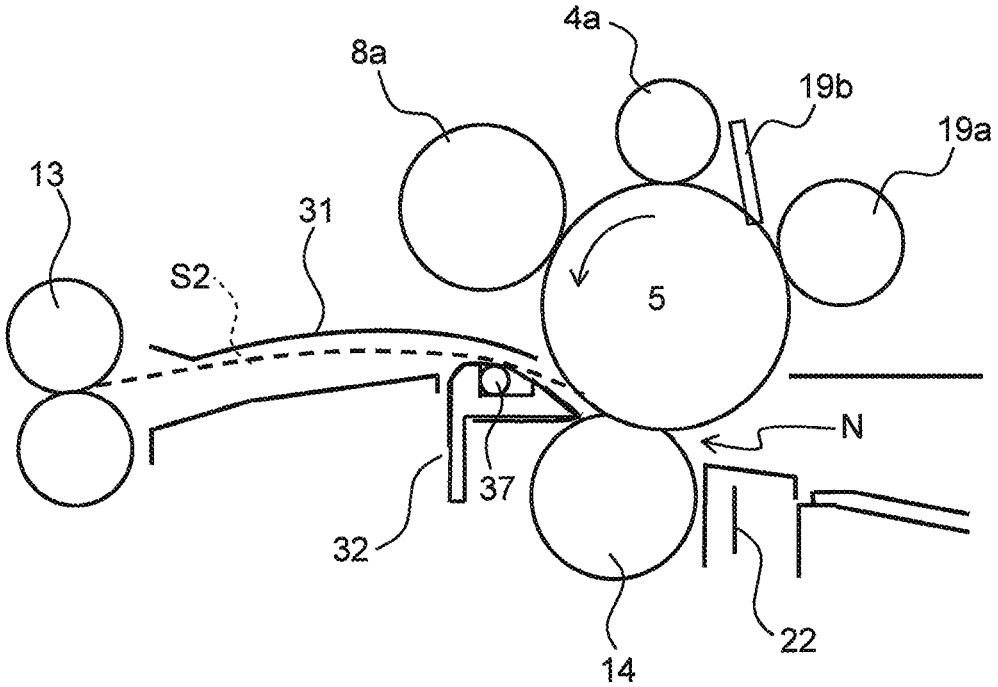
FIG. 13 is a side sectional view showing a conveyance state of a sheet conveyed from the registration roller pair to the transfer nip in the image forming apparatus of the second embodiment when the sheet is a thick paper sheet.
Figure 14:
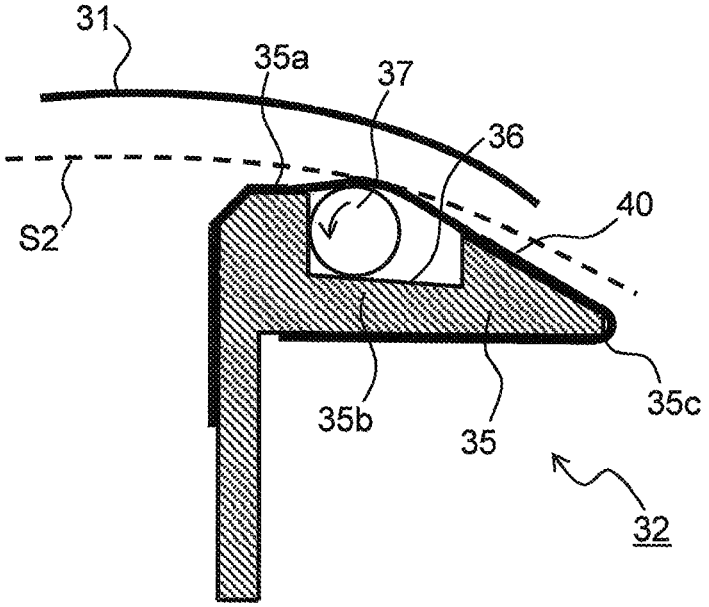
FIG. 14 is an enlarged view of a lower conveyance guide shown in FIG. 13.

FIG. 13 is a side sectional view showing a conveyance state of the sheet S conveyed from the registration roller pair 13 to the transfer nip N in the image forming apparatus 100 of the second embodiment when the sheet is a thick paper sheet S2. FIG. 14 is a side sectional view of the lower conveyance guide 32, and shows a state where the thick paper sheet S2 shown in FIG. 13 is conveyed. As shown in FIG. 14, when conveying the thick paper sheet S2 with a high stiffness, the shaft member 37 is pushed back by the stiffness (restoring force) of the thick paper sheet S2 toward the upstream side in the conveyance direction to be held at the second position in the shaft holding portion 35*b*.

As a result, the topmost portion of the shaft member 37 moves away from the upper conveyance guide 31, the conveyance load in conveying the thick paper sheet S2 is reduced. Further, the amount of movement of the shaft member 37 in the conveyance direction is restricted by the length of the shaft holding portion 35*b* in the conveyance direction, and thus, the distance between the shaft member 37 and the upper conveyance guide 31 when the shaft member 37 has moved to the second position is maintained constant. Accordingly, also when conveying the thick paper sheet S2, it is possible to reduce the conveyance load while minimizing the fluttering width of the thick paper sheet S2.

Accordingly, as in the first embodiment, fluttering of the rear end of the sheet S is reduced regardless of the stiffness of the sheet S, and thus toner scattering at the development nip due to generation of an airflow can be suppressed. Furthermore, it is also possible to suppress reduction of the transfer magnification and occurrence of transfer displacement due to an increased conveyance load with respect to the sheet S.

Further, with the film member 40 covering the main body portion 35 together with the shaft member 37, there is no risk of the leading end of the sheet S entering the gap between the shaft member 37 and the shaft holding portion 35*b*, and jamming of the sheet S passing over the lower conveyance guide 32 can be prevented. Further, it is unlikely for foreign matters such as toner, paper dust, etc. to enter the shaft holding portion 35*b*, and this makes it possible to maintain smooth movement of the shaft member 37 in the conveyance direction over a long period of time.

Moreover, with the first support surface 36 of the shaft holding portion 35*b* formed as a slope inclined downward toward the downstream side in the conveyance direction, it is possible, when conveying the regular paper sheet S1, to securely hold the shaft member 37 at the first position by means of its own weight.

Figure 15:
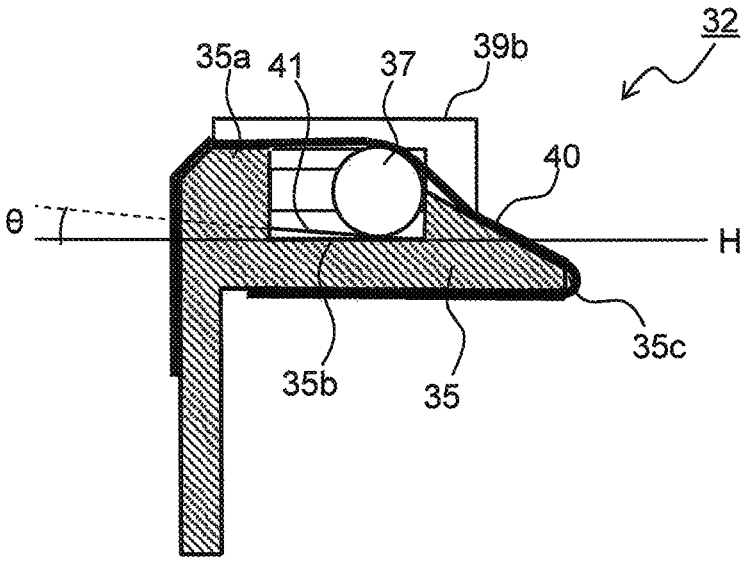
FIG. 15 is a side sectional view showing a modified example of the lower conveyance guide used in the image forming apparatus of the second embodiment.

Here, in the present embodiment, the first support surface 36 of the shaft holding portion 35*b* is formed as a slope, but instead, as in a modified example shown in FIG. 15, a second support surface 41 of each of the bearing members 39*a* and 39*b*, respectively supporting the opposite end portions of the shaft member 37, may be formed as a slope inclined downward toward the downstream side in the conveyance direction.

The present disclosure is not limited to the embodiments described above and various modifications thereto can be made without departing from the spirit and scope of the present disclosure. For example, the distance between the projection portion 35*a* and the upper conveyance guide 31, the amount of projection of the shaft member 37, the dimensions of the shaft holding portion 35*b*, etc. can be set appropriately in accordance with the size, the type, etc. of the sheet S conveyed.

Further, needless to say, the present disclosure is usable not only in monochrome printers as shown in FIG. 1, but also in other types of image forming apparatuses such as color printers, monochrome and color copiers, digital multifunction peripherals, facsimile machines, etc., and sheet post-processing devices which are coupled to image forming apparatuses.

The present disclosure is usable in image forming apparatuses, such as copiers, printers, facsimile machines, etc., that are provided with a conveyance guide on the upstream side of the transfer nip. Use of the present disclosure makes it possible to provide an image forming apparatus capable of effectively suppressing fluttering of the recording medium on the upstream side of the transfer nip and is also capable of reducing the conveyance load when conveying a recording medium with a high stiffness.

What is claimed is:

1. An image forming apparatus comprising:

an image carrier;

a transfer member which transfers a toner image formed on the image carrier onto a recording medium;

a registration roller pair which conveys the recording medium to a transfer nip between the transfer member and the image carrier with a predetermined timing; and a conveyance guide which includes:

a first conveyance guide which faces an image-carrier-side surface of the recording medium conveyed from the registration roller pair to the transfer nip; and a second conveyance guide which faces a transfer-member-side surface of the recording medium, wherein the second conveyance guide includes:

a main body portion which has a projection portion which projects furthest toward the first conveyance guide in a recording-medium conveyance path from the registration roller pair to the transfer nip, and a shaft holding portion which is formed adjacent to the projection portion on a downstream side of the projection portion with respect to the recording-medium conveyance direction so as to extend along a width direction which is perpendicular to the recording-medium conveyance direction; and a shaft member which is held by the shaft holding portion and is reciprocatable between a first position which is a most downstream-side position in the shaft holding portion with respect to the recording-medium conveyance direction and a second position which is a position on an upstream side of the first position in the shaft holding portion, an outer peripheral surface of the shaft member projects toward the first conveyance guide beyond a plane passing through a downstream-side first-conveyance-guide-side end portion of the projection portion and a downstream-side first-conveyance- guide-side end portion of the shaft holding portion with respect to the recording-medium conveyance direction, and when a first recording medium is conveyed, the shaft member is arranged at the first position such that a distance between the shaft member and the first conveyance guide is equal to a predetermined distance, and when a second recording medium having a higher stiffness than the first recording medium is conveyed, the shaft member is arranged at the second position such that the distance between the shaft member and the first conveyance guide is larger than when the shaft member is arranged at the first position.

2. The image forming apparatus according to claim 1, wherein the second conveyance guide has a film member which covers a surface of the main body portion that faces the first conveyance guide, together with the shaft member.

3. The image forming apparatus according to claim 2, wherein the film member covers, in a part in a width direction perpendicular to the recording-medium conveyance direction, the face of the main body portion that faces the first conveyance guide, together with the shaft member.

4. The image forming apparatus according to claim 2, wherein the film member covers, over an entire region in a width direction perpendicular to the recording-medium conveyance direction, the face of the main body portion that faces the first conveyance guide, together with the shaft member.

5. The image forming apparatus according to claim 4, wherein the shaft holding portion has a first support surface which supports the shaft portion so as to be reciprocatable between the first position and the second position, and the first support surface has a slope that is inclined downward toward a downstream side in the recording-medium conveyance direction.

6. The image forming apparatus according to claim 4, wherein the second conveyance guide includes a pair of bearing members which are arranged at opposite end portions of the main body portion in the width direction, which each have a second support surface which supports the shaft member so as to be reciprocatable in the recording-medium conveyance direction, and which regulate axial movement of the shaft member, and the second support surface has a slope that is inclined downward toward a downstream side in the recording-medium conveyance direction.

7. The image forming apparatus according to claim 2, wherein the film member is electrically conductive.

8. The image forming apparatus according to claim 7, wherein the film member is grounded via the main body portion.

9. The image forming apparatus according to claim 7, wherein the film member is grounded via a resistor with a resistance of an order of megohms.

10. The image forming apparatus according to claim 2, wherein the film member is an ultra-high molecular weight polyethylene sheet.

11. The image forming apparatus according to claim 1, wherein the recording-medium conveyance path is a reverse-V shaped path that is inclined once upward from the registration roller pair and then downward toward the transfer nip.

* * * * *